US005361488A

United States Patent [19]

Higashiguchi et al.

[11] Patent Number: 5,361,488

[45] Date of Patent: Nov. 8, 1994

[54] MANUFACTURING METHOD FOR ANTENNA MODULE

[75] Inventors: Yutaka Higashiguchi; Mitsuo Inagaki; Hidenori Tanizawa; Takeyasu Maeda, all of Kawasaki; Noriyuki Kohma, Tokyo; Hajime Mochizuki, Tokyo; Kouroh Mekata, Tokyo; Toshiaki Amano, Tokyo; Yoshikazu Kamei, Tokyo, all of Japan

[73] Assignee: Fujitsu Limited, Kawasaki, Japan

[21] Appl. No.: 165,120

[22] Filed: Dec. 10, 1993

[30] Foreign Application Priority Data

Dec. 11, 1992 [JP] Japan ..... 4-331553

[51] Int. Cl.[5] ..... H01Q 1/12

[52] U.S. Cl. ..... 29/600; 29/411; 29/417; 264/261; 343/702

[58] Field of Search ..... 29/600, 411, 417; 264/157, 261, 269; 343/702

[56] References Cited

U.S. PATENT DOCUMENTS 4,420,450 12/1983 Marsh ..... 264/157
4,427,615 1/1984 Eskeson ..... 264/261
5,268,702 12/1993 Amano et al. ..... 343/702

FOREIGN PATENT DOCUMENTS 4185003 7/1992 Japan .

*Primary Examiner*—Mark Rosenbaum
*Assistant Examiner*—David P. Bryant

[57] ABSTRACT

A manufacturing method for plural antenna modules which is suitable for mass production. Each antenna module includes a ground element, an antenna element, a loop element, and an element support. The manufacturing method for the antenna modules includes a first step of setting in a mold a first conductive base material including a plurality of the ground elements integrally connected together, a second conductive base material including a plurality of the antenna elements integrally connected together, and a third conductive base material including a plurality of the loop elements integrally connected together; a second step of filling a cavity defined in the mold with a curing fluid and then curing the curing fluid to thereby form an element support base material including a plurality of the element supports integrally connected together; and a third step of cutting the element support base material together with the first, second and third conductive base materials to thereby obtain a plurality of the antenna modules.

13 Claims, 7 Drawing Sheets

MANUFACTURING METHOD FOR ANTENNA MODULE

BACKGROUND OF THE INVENTION

1. Field of the Invention

The present invention relates to a manufacturing method for an antenna module to be incorporated in wireless terminal equipment such as a portable telephone.

2. Description of the Related Art

In recent years, wireless terminal equipment such as a portable telephone has widely been put to practical use with an increase in communication demand. An antenna module is usually incorporated in a housing of the wireless terminal equipment, so as to ensure a receiving function in carrying the equipment. The antenna module is required to essentially have required electrical characteristics concerning a resonance frequency, a band width, a gain, etc. and additionally have a feature that the module is fit for a reduction in size and weight of the equipment. Further, a manufacturing method for such an antenna module suitable for mass production is required, so as to reduce the cost of the antenna module.

As such a conventional antenna module to be incorporated in a portable telephone, there are known a platelike inverted F-shaped antenna 2 as shown in FIG. 1 and an S-shaped antenna 4 as shown in FIG. 2. These antenna modules are formed by a sheeting technique, so that they are not necessarily fit for a reduction in size of the equipment. Further, to ensure required electrical characteristics, a high accuracy is required not only for an external size of each element but also for a gap size between an antenna element and a ground element, thus necessitating a high working technique.

FIG. 3 shows another conventional antenna module fit for a reduction in size and weight, which is now in practical use. This antenna module is integrally constructed of a resin molding and a metal conductor foil by the use of a mold. As shown in FIG. 3, the antenna module is provided with a ground element 6 and an antenna element 8 each formed from a metal conductor foil, a loop element 10 electrically connected to the antenna element 8, and an element support 12 formed from an insulator, for supporting the ground element 6, the antenna module 8 and the loop element 10.

The element support 12 is formed with a hollow portion 12A extending in the longitudinal direction for the purposes of reducing a weight and obtaining a required permittivity of the element support 12. However, considering the shape of the mold to be used in manufacturing the antenna module shown in FIG. 3, only one antenna module can be obtained by a single molding step. Accordingly, the mass production of plural antenna modules is difficult.

SUMMARY OF THE INVENTION

It is therefore an object of the present invention to provide a manufacturing method for plural antenna modules which is suitable for mass production.

In accordance with an aspect of the present invention, there is provided a manufacturing method for a plurality of antenna modules each having a ground element formed from a planar conductor; an antenna element formed from a planar conductor, said antenna element being arranged in substantially parallel relationship to said ground element; a loop element formed from a tubular conductor, said loop element being arranged between said ground element and said antenna element in predetermined positional relationship with both said ground and antenna elements and connected with said antenna element; and an element support formed from an insulator, for supporting said ground element, said antenna element and said loop element; said manufacturing method comprising the steps of (a) setting in a mold a first conductive base material including a plurality of said ground elements integrally connected together, a second conductive base material including a plurality of said antenna elements integrally connected together, and a third conductive base material including at least a portion of a plurality of said loop elements integrally connected together; (b) filling a cavity defined in said mold with a curing fluid and then curing said curing fluid to thereby form an element support base material on which said first, second and third conductive base materials are bonded, said element support base material including a plurality of said element supports integrally connected together; and (c) cutting said element support base material together with said first, second and third conductive base materials to thereby obtain a plurality of said antenna modules.

Preferably, said mold comprises a first mold having a first projection facing an inside surface of said third conductive base material and a second mold having a second projection facing an outside surface of said third conductive base material; and a direction of drawing of one of said first and second molds relative to the other is parallel to cutting planes along which said element support base material is cut together with said first, second and third conductive base materials in said step (c).

According to the manufacturing method of the present invention, the first, second and third conductive base materials are set in the mold, and the curing fluid is then introduced into the cavity of the mold to integrally mold the element support base material on which the first, second and third conductive base materials are bonded. Then, the molding thus obtained is cut into a plurality of products as the plural antenna modules. Accordingly, the plural antenna modules can be obtained by a single molding step.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
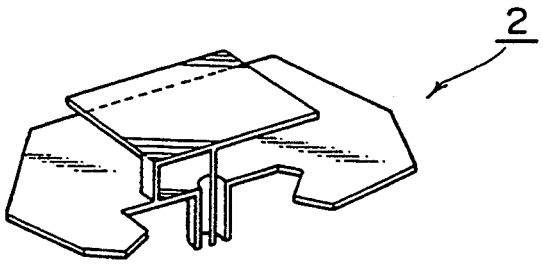
FIG. 1 PRIOR ART
FIG. 1 is a schematic perspective view of an inverted F-shaped antenna in the prior art.
Figure 2:
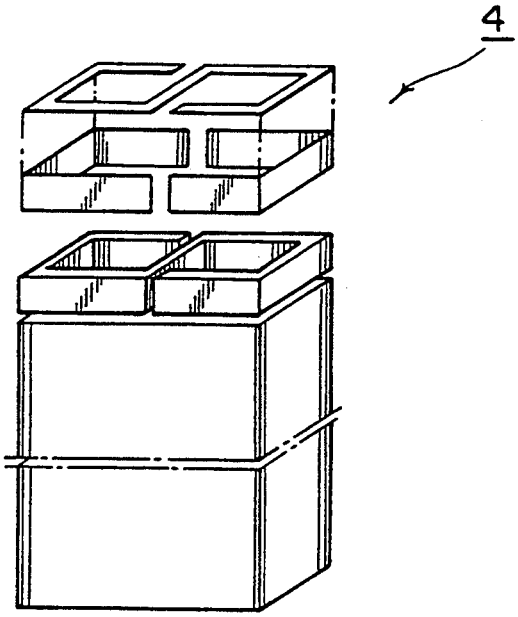
FIG. 2 PRIOR ART
FIG. 2 is a schematic perspective view of an S-shaped antenna in the prior art.
Figure 3:
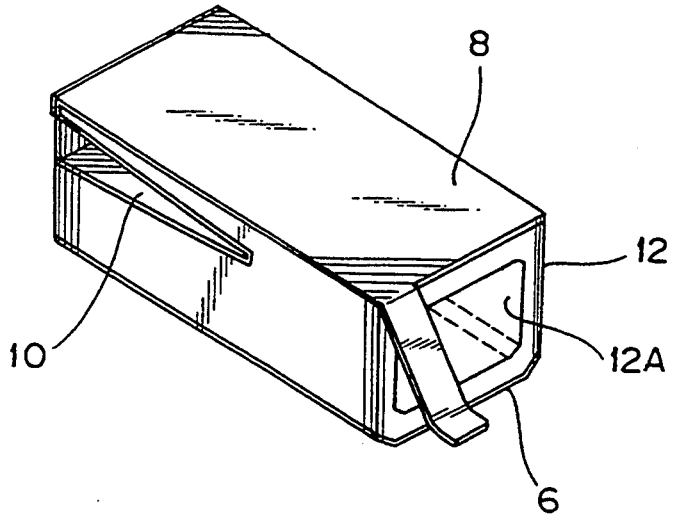
FIG. 3 PRIOR ART
FIG. 3 is a schematic perspective view of a conventional antenna module constructed of a resin molding and a metal conductor foil.
Figure 4:
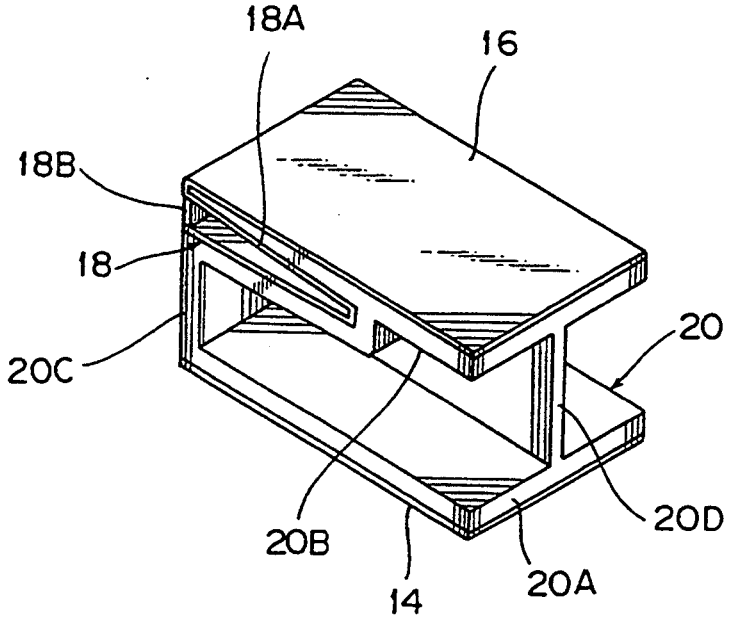
FIG. 4 is a perspective view of an antenna module manufactured by the method of the present invention.

FIG. 4 is a perspective view showing an example of antenna modules manufactured by the method of the present invention. A ground element 14 designed to become a ground potential is formed from a rectangular planar conductor (e.g., copper foil ). Similarly, an antenna element 16 is formed from a planar conductor. The antenna element 16 is arranged so as to be opposed to the ground element 14. The ground element 14 and the antenna element 16 are substantially parallel to each other.

A loop element 18 is formed from a rectangular tubular conductor. The loop element 18 is provided between the ground element 14 and the antenna element 16 in predetermined positional relationship to these elements. The loop element 18 is electrically connected with the antenna element 16. In this example, the loop element 18 is composed of a portion 18A integral with the antenna element 16 and an after-attachment 18B to be bonded to the portion 18A by soldering or the like.

The ground element 14, the antenna element 16 and the loop element 18 are supported by an element support 20 formed from an insulator. The element support 20 has a first supporting portion 20A for supporting the ground element 14, a second supporting portion 20B for supporting the antenna element 16 and the loop element 18, a connecting portion 20C for connecting the first and second supporting portions 20A and 20B on the loop element 18 side, and a rib 20D extending at right angles to the connecting portion 20C, for connecting the first and second supporting portions 20A and 20B.

According to the construction of the antenna module shown in FIG. 4, all the elements 14, 16 and 18 are supported by the element support 20 formed from an insulator (dielectric), so that the antenna module can be reduced in size. Further, owing to the above-mentioned specific structure of the element support 20, the antenna module can be reduced in size and weight.

In the antenna module shown in FIG. 4, a primary factor deciding the electrical characteristics of the module consists of the shapes of the elements 14, 16 and 18, and the distances between the antenna element 16 and the ground element 14 and between the loop element 18 and the ground element 14. In particular, the resonance frequency of the antenna module largely depends on the distance between the loop element 18 and the ground element 14. For example, when this distance changes by 1 mm in the antenna module having a height of 10 mm, a width of 15 mm and a length of 40 mm, the resonance frequency changes by about 50 MHz.

In the case where the element support 20 is formed by integral molding using a mold, constant electrical characteristics can be obtained owing to a high dimensional accuracy of the element support 20. Further, since the element support 20 shown in FIG. 4 has the rib 20D, there is no possibility that the positional relationship between the elements 14, 16 and 18 may be fluctuated by an external force or the like. When the material of the element support 20 has a high rigidity, the rib 20D may be eliminated.

Figure 5:
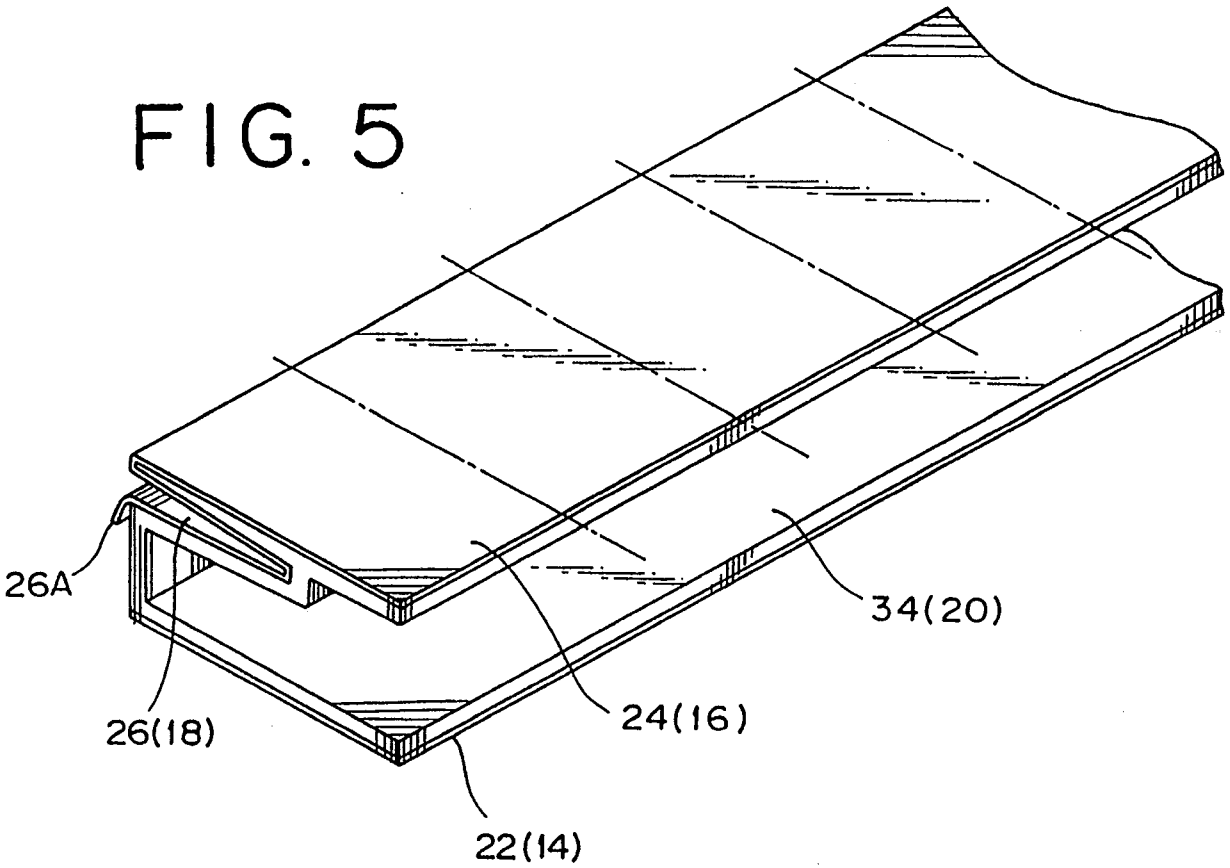
FIG. 5 is a perspective view illustrating a first preferred embodiment of the present invention.

FIG. 5 shows a first preferred embodiment of the present invention in manufacturing the antenna module as shown in FIG. 4. It should be noted that the element support 20 of the antenna module to be manufactured in this preferred embodiment is not formed with the rib 20D. Referring to FIG. 5, reference numeral 22 denotes a first base material as an integral set of plural ground elements 14; reference numeral 24 denotes a second base material as an integral set of plural antenna elements 16; and reference numeral 26 denotes a third base material as an integral set of plural loop elements 18. Each of the base materials 22, 24 and 26 is formed from a conductor foil such as a copper foil. In this preferred embodiment, the second base material 24 is integral with the third base material 26.

Figure 6:
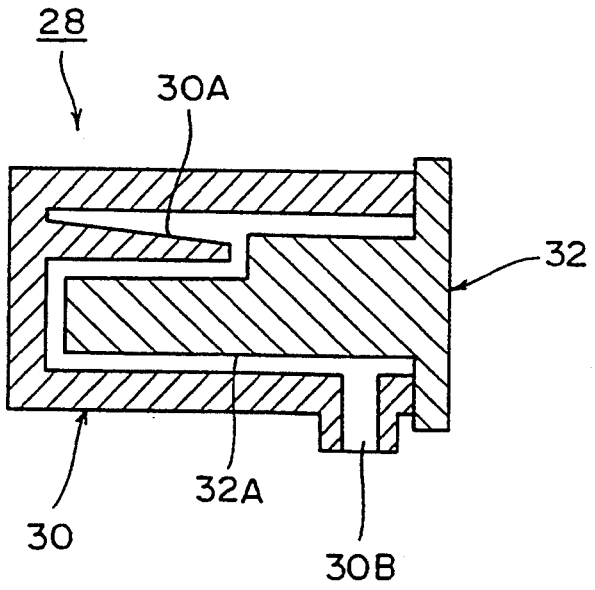
FIG. 6 is a sectional view of a mold employable in practicing the present invention.

In the first step, all the base materials 22, 24 and 26 are set in a mold 28 as shown in FIG. 6. The mold 28 is composed of a first mold 30 having a projection 30A facing the inside surface of the third base material 26 and a second mold 32 having a projection 32A facing the outside surface of the third base material 26. In setting the base materials 22, 24 and 26 in the mold 28, the first base material 22 is disposed in contact with the bottom inside surface of the first mold 30; the second base material 24 is disposed in contact with the top inside surface of the first mold 30; and the third base material 26 is disposed so as to cover the projection 30A of the first mold 30.

In the second step, a curing fluid is introduced into a cavity defined in the mold 28, and is then cured to thereby form plural element supports 20. The curing fluid is injected from a mold gate 30B formed through a lower portion of the first mold 30, for example. In this preferred embodiment, the rib 20D shown in FIG. 4 is not formed in each element support 20, so that the cavity defined in the mold 28 is a single cavity, and the plural element supports 20 are formed as an integral fourth base material 34 (see FIG. 5).

In the third step, the first, second, third and fourth base materials 22, 24, 26 and 34 are cut along parallel planes shown by dash-dot lines in FIG. 5. Finally, an edge portion 26A of each cut piece of the third base material 26 is soldered to an end portion of each cut piece of the second base material 24, thus completing each loop element 18. Alternatively, prior to cutting each base material in the third step, the third base material 26 may be soldered to the second base material 24 to thereby preliminarily form an integral set of the loop elements 18.

As the curing fluid to be introduced into the mold 28 shown in FIG. 6, thermosetting resin such as epoxy resin may be used, or thermoplastic resin may be used instead, of course. In this preferred embodiment, the direction of drawing of one of the first and second molds 30 and 32 relative to the other after curing the curing fluid is set parallel to the cutting planes shown in FIG. 5. Accordingly, as compared with the case where the mold drawing direction is set perpendicular to the cutting planes, variations in shapes of the plural antenna modules to be obtained can be made smaller. Further, according to this preferred embodiment, each loop element 18 is formed by soldering the edge portion 26A of each cut piece of the third base material 26 after molding, so that the after-attachment 18B as shown in FIG. 4 is unnecessary to use.

Figure 7:
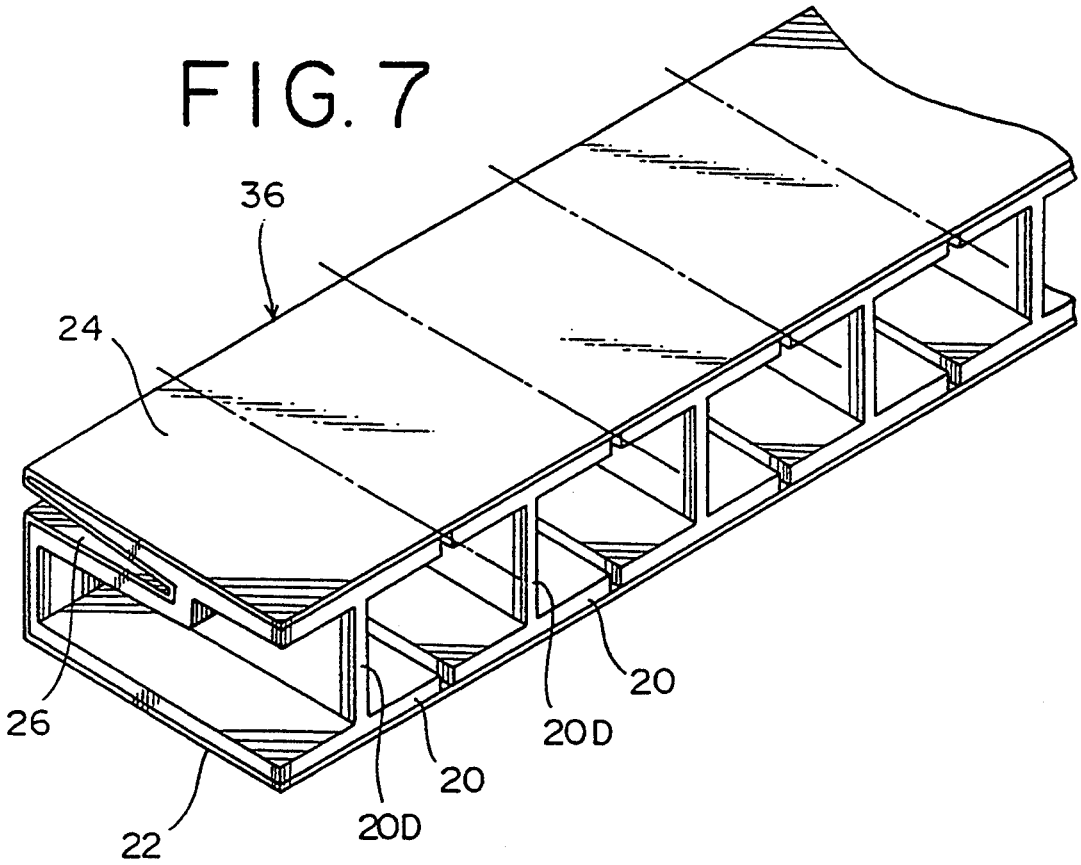
FIG. 7 is a perspective view illustrating a second preferred embodiment of the present invention.

FIG. 7 shows a second preferred embodiment of the present invention. In this preferred embodiment, the first, second and third base materials 22, 24 and 26 are formed from a conductor layer of a single flexible printed wiring board 36. Further, a plurality of cavities are defined in a mold for forming a plurality of element supports 20, and in the second step, the curing fluid is individually introduced into the plural cavities defined in the mold. As a result, a unit of the plural element supports 20 supported by the single flexible printed wiring board 36 can be obtained as an intermediate product in the molding step. In this preferred embodiment, the mold is modified in shape so that the rib 20D (see FIG. 4) may be formed as a portion of each element support 20.

Figure 8:
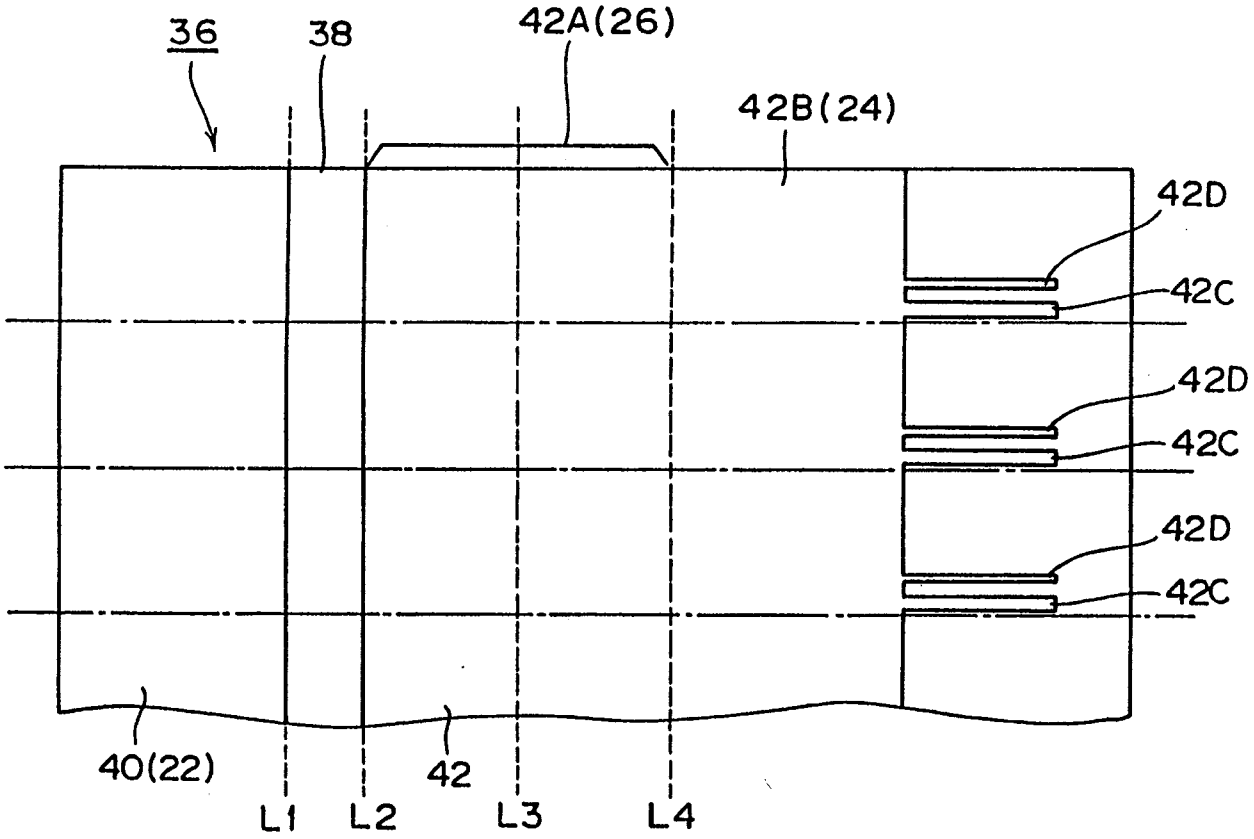
FIG. 8 is a development of a flexible printed wiring board used in the second preferred embodiment shown in FIG. 7.

FIG. 8 is a development of the flexible printed wiring board 36 shown in FIG. 7. The flexible printed wiring board 36 has a single, substantially rectangular resin film 38 and the above-mentioned conductor layer formed on the resin film 38. The conductor layer is composed of a first pattern 40 corresponding to the first base material 22 and a second pattern 42 including the second and third base materials 24 and 26. The resin film 38 is formed of polyimide resin, for example. The first and second patterns 40 and 42 are obtained by etching a conductor foil formed on the resin film 38, for example.

The second pattern 42 includes a loop element pattern 42A corresponding to the third base material 26 to become the loop elements, an antenna element pattern 42B corresponding to the second base material 24 to become the antenna elements, and line patterns 42C and 42D to be used for interfaces to a high-frequency circuit. The line patterns 42C and 42D function as a ground line and a signal line at high frequencies, respectively. The shapes of the line patterns 42C and 42D may be set according to the required characteristics such as impedance characteristics.

In FIG 8, broken lines L1 to L4 arranged in series from the first pattern 40 side represent bending lines in bending the flexible printed wiring board 36. More specifically, the flexible printed wiring board 36 is bent along the bending lines L1, L2 and L4 so that the first and second patterns 40 and 42 become outside, and is bent along the bending line L3 so that the second pattern 42 becomes inside.

The flexible printed wiring board 36 thus bent is set in the mold. At this time, the first, second and third base materials 22, 24 and 26 can be easily seated on the inside surface of the mold at the predetermined positions because they are formed on the single resin film 38 of the flexible printed wiring board 36, thereby improving the workability. In this preferred embodiment, since the base materials 22, 24 and 26 are formed on the single resin film 38, it is required to solder the after-attachment 18B (see FIG. 4) to the third base material 26 after the molding step, so as to form the loop elements. Some examples of the shape of the after-attachment 18B will be described with reference to FIGS. 9A and 9B.

Figure 9A:
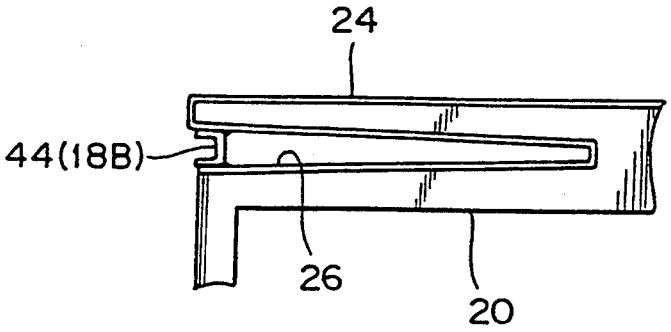
FIGS. 9A and 9B are partially cutaway, side elevations of different antenna modules, illustrating some examples of an after-attachment employable in the present invention.
Figure 9B:
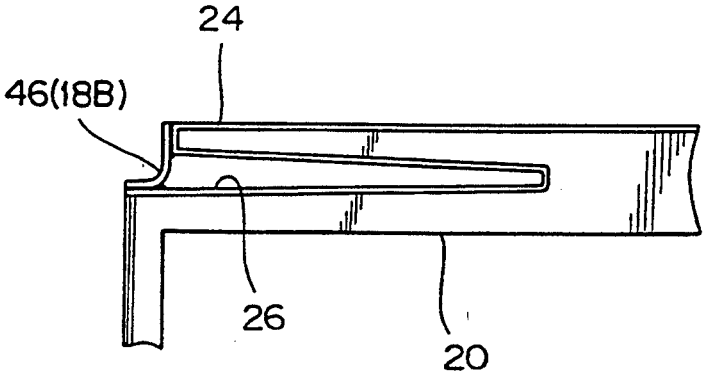

In the example shown in FIG. 9A, a conductor ribbon 44 having a C-shaped cross section is used as the after-attachment 18B. The conductor ribbon 44 is soldered to the third base material 26, thereby forming the loop elements. In the example shown in FIG. 9B, a conductor ribbon 46 having an L-shaped cross section is used as the after-attachment 18B. The conductor ribbon 46 is soldered to an end portion of the second base material 24 and an end portion of the third base material 26. In this example, to easily carry out the soldering of the conductor ribbon 46, the element support 20 is modified in shape in such a manner that the end portion of the second base material 24 is retracted from the end portion of the third base material 26.

In the first step, the flexible printed wiring board 36 is set in the mold in such a manner that the curing fluid is to come into contact with a first surface of the resin film 38 (see FIG. 8) opposite to a second surface thereof on which the conductor layer is formed, so as to ensure a bonding strength between the flexible printed wiring board 36 and the element supports 20 upon curing of the curing fluid in the mold. Alternatively, adhesive may be preliminarily applied to the first surface of the resin film 38, thereby improving the bonding strength between the flexible printed wiring board 36 and the element supports 20 upon curing of the curing fluid in the mold.

In the preferred embodiment shown in FIG. 7, the intermediate product composed of the flexible printed wiring board 36 and the plural element supports 20 supported thereon is prepared in the second step. Accordingly, in the third step, it is sufficient to cut the flexible printed wiring board 36 only, thereby improving the workability. In the preferred embodiment shown in FIG. 7 wherein each element support 20 is formed with the rib 20D, each mold gate 30B of the mold (see FIG. 6) is preferably positioned so as to correspond to the rib 20D of each element support 20. With this arrangement, the flexible printed wiring board 36 is hardly wrinkled in injecting the curing fluid into the mold. Even if the flexible printed wiring board 36 is wrinkled, the wrinkles appear at the positions corresponding to the cutting areas of the flexible printed wiring board 36, thus ensuring a good yield of the antenna modules.

Figure 10:
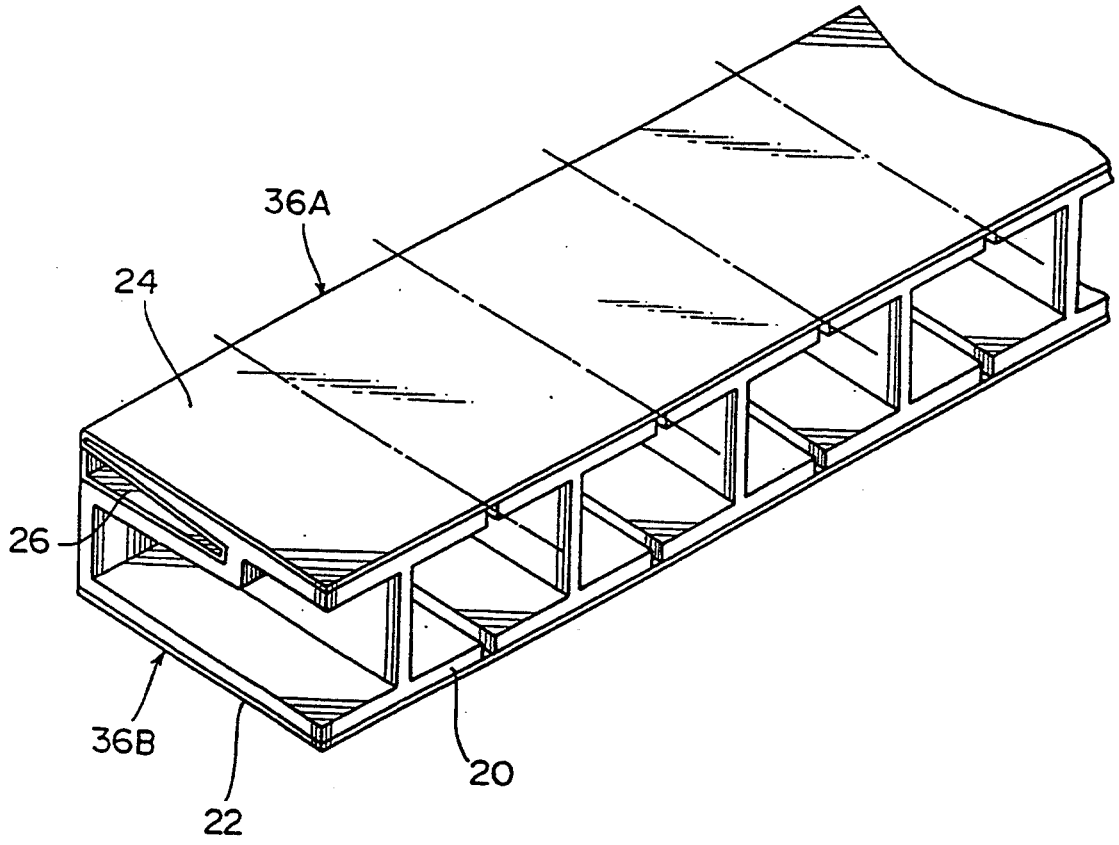
FIG.10 is a perspective view illustrating a third preferred embodiment of the present invention.

FIG. 10 shows a third preferred embodiment of the present invention. In this preferred embodiment, two flexible printed wiring boards 36A and 36B are used, so as to eliminate the use of the after-attachment 18B. Each of the flexible printed wiring boards 36A and 36B has a substantially rectangular resin film and a conductor layer formed on the resin film. The conductor layer of the flexible printed wiring board 36A has a pattern including the second and third base materials 24 and 26, and the conductor layer of the flexible printed wiring board 36B is a pattern corresponding to the first base material 22. According to this preferred embodiment, an end portion of the third base material 26 is soldered to the second base material 24 to thereby form the loop elements, thus eliminating the use of the after-attachment 18B.

What is claimed is:

1. A manufacturing method for a plurality of antenna modules each having a ground element formed from a planar conductor; an antenna element formed from a planar conductor, said antenna element being arranged in substantially parallel relationship to said ground element; a loop element formed from a tubular conductor, said loop element being arranged between said ground element and said antenna element in predetermined positional relationship with both said ground and antenna elements and connected with said antenna element; and an element support formed from an insulator, for supporting said ground element, said antenna element and said loop element; said manufacturing method comprising the steps of:

(a) setting in a mold a first conductive base material including a plurality of said ground elements integrally connected together, a second conductive base material including a plurality of said antenna elements integrally connected together, and a third conductive base material including at least a portion of a plurality of said loop elements integrally connected together;

(b) filling a cavity defined in said mold with a curing fluid and then curing said curing fluid to thereby form an element support base material on which said first, second and third conductive base materials are bonded, said element support base material including a plurality of said element supports integrally connected together; and (c) cutting said element support base material together with said first, second and third conductive base materials to thereby obtain a plurality of said antenna modules.

2. A manufacturing method according to claim 1, wherein:

said mold comprises a first mold having a first projection facing an inside surface of said third conductive base material and a second mold having a second projection facing an outside surface of said third conductive base material; and a direction of drawing of one of said first and second molds relative to the other is parallel to cutting planes along which said element support base material is cut together with said first, second and third conductive base materials in said step (c).

3. A manufacturing method according to claim 2, wherein said second conductive base material is integrally formed with said third conductive base material.

4. A manufacturing method according to claim 2, wherein said cavity defined in said mold comprises a single cavity.

5. A manufacturing method according to claim 2, wherein said cavity defined in said mold comprises a plurality of cavities separated from each other, and said curing fluid is individually introduced into said plural cavities in said step (b).

6. A manufacturing method according to claim 2, wherein each of said element supports comprises a first supporting portion for supporting said ground element, a second supporting portion for supporting said antenna element and said loop element, a connecting portion for connecting said first and second supporting portions on said first mold side, and a rib provided in parallel to said cutting planes, for connecting said first and second supporting portions.

7. A manufacturing method according to claim 6, wherein said mold has a plurality of mold gates from which said curing fluid is injected into said cavity, said mold gates being positioned so as to respectively correspond to said ribs of said element supports.

8. A manufacturing method according to claim 2, wherein said first, second and third conductive base materials are formed from a conductor layer of a flexible printed wiring board.

9. A manufacturing method according to claim 8, wherein:

said flexible printed wiring board comprises a single, substantially rectangular resin film and said conductor layer formed on said resin film;

said conductor layer comprises a first pattern corresponding to said first conductive base material and a second pattern including said second and third conductive base materials; and said manufacturing method further comprising a step of soldering an after-attachment to said second and third conductive base materials to complete said plural loop elements.

10. A manufacturing method according to claim 9, wherein said after-attachment comprises a conductor ribbon having a C-shaped cross section.

11. A manufacturing method according to claim 9, wherein said after-attachment comprises a conductor ribbon having an L-shaped cross section.

12. A manufacturing method according to claim 8, wherein:

said flexible printed wiring board comprises first and second resin films each having a substantially rectangular shape;

said conductor layer comprises a first pattern formed on said first resin film and corresponding to said first conductive base material, and a second pattern formed on said second resin film and including said second and third conductive base materials; and said manufacturing method further comprising a step of soldering an end portion of said third conductive base material to said second conductive base material to complete said plural loop elements.

13. A manufacturing method according to claim 8, wherein:

said flexible printed wiring board comprises a resin film and said conductor layer formed on said resin film;

said manufacturing method further comprising a step of applying adhesive to a first surface of said resin film opposite to a second surface thereof on which said conductive layer is formed; and said curing fluid is introduced into said cavity of said mold in said step (b) so that said curing fluid comes into close contact with said first surface of said resin film on which said adhesive is applied.

* * * * *

UNITED STATES PATENT AND TRADEMARK OFFICE

CERTIFICATE OF CORRECTION

PATENT NO. : 5,361,488

DATED : November 8, 1994

INVENTOR(S) : Yutaka Higashiguchi et al.

It is certified that error appears in the above-indentified patent and that said Letters Patent is hereby corrected as shown below:

On the Title Page, add the following information to item [73] Assignee:

--THE FURUKAWA ELECTRIC CO., LTD. having a place of business at 6-1 Marunouchi 2-chome, Chiyoda-ku, Tokyo, 100 Japan.--

Signed and Sealed this

Twenty-eight Day of February, 1995

*Attest:*

Bruce Lehman

BRUCE LEHMAN

*Attesting Officer*

*Commissioner of Patents and Trademarks*